US009512557B1

(12) United States Patent
Snipe et al.

(10) Patent No.: US 9,512,557 B1
(45) Date of Patent: Dec. 6, 2016

(54) STORAGE CADDY FOR AN IRONING BOARD

(71) Applicants: Allen B. Snipe, Newark (DE); Maria A. Snipe, Newark (DE)

(72) Inventors: Allen B. Snipe, Newark (DE); Maria A. Snipe, Newark (DE)

( * ) Notice: Subject to any disclaimer, the term of this patent is extended or adjusted under 35 U.S.C. 154(b) by 0 days.

(21) Appl. No.: 14/580,349

(22) Filed: Dec. 23, 2014

(51) Int. Cl.
*D06F 81/00* (2006.01)
*D06F 81/10* (2006.01)
*D06F 83/00* (2006.01)

(52) U.S. Cl.
CPC ..... *D06F 81/00* (2013.01); *D06F 81/10* (2013.01); *D06F 83/00* (2013.01)

(58) Field of Classification Search
CPC ..... D06F 83/00; D06F 81/00; D06F 81/14; D06F 81/003; D06F 81/006; D06F 95/00; D06F 95/004; A47F 5/00; A44B 18/00; A44B 18/0023
USPC ..... 2/247
See application file for complete search history.

(56) References Cited

U.S. PATENT DOCUMENTS 779,898 A * 1/1905 Yates ..... A41D 27/20 139/224 R
837,824 A * 12/1906 Gibson ..... F42B 39/02 2/247
1,669,791 A * 5/1928 Stocks ..... A41D 27/20 2/247
1,708,786 A * 4/1929 Cohen ..... A41D 27/20 2/247
2,241,309 A * 5/1941 Kovalik ..... D06F 95/004 108/25
2,884,722 A 5/1959 Lehrman
3,334,357 A * 8/1967 Stults ..... A41D 27/20 2/247
4,154,010 A 5/1979 Evans
4,535,921 A 8/1985 Sanders
4,893,770 A 1/1990 Bejak
5,379,536 A 1/1995 Lorenzana
5,743,417 A 4/1998 Mathis
D414,007 S 9/1999 Hernandez
D434,541 S 11/2000 Black
7,299,573 B1 * 11/2007 Kuncken ..... D06F 83/00 38/140
2003/0136035 A1 * 7/2003 Lehrman ..... D06F 83/00 38/140
2004/0149877 A1 8/2004 Hermann
2005/0235529 A1 * 10/2005 Hsu ..... D06F 81/00 38/137
2010/0126050 A1 * 5/2010 Glenn ..... D06F 83/00 38/140

* cited by examiner

*Primary Examiner* — Ismael Izaguirre

(57) ABSTRACT

The caddy assembly includes a panel that may be coupled to the ironing board. A coupler is coupled to the panel. The coupler engages the ironing board. The panel is retained on the ironing board. A pocket is coupled to the panel. The panel contains an object. The object is accessible to a user.

9 Claims, 4 Drawing Sheets

STORAGE CADDY FOR AN IRONING BOARD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of storage caddies, more specifically, a storage caddy for an ironing board.

SUMMARY OF THE INVENTION

An embodiment of the disclosure meets the needs presented above by generally comprising a panel that may be coupled to the ironing board. A coupler is coupled to the panel. The coupler engages the ironing board. The panel is retained on the ironing board. A pocket is coupled to the panel. The panel contains an object. The object is accessible to a user.

An object of the invention is to provide a device that is storage caddy for an ironing board.

These together with additional objects, features and advantages of the storage caddy for an ironing board will be reading the following detailed description of presently preferred, but nonetheless illustrative, embodiments of the storage caddy for an ironing board when taken in conjunction with the accompanying drawings.

In this respect, before explaining the current embodiments of the storage caddy for an ironing board in detail, it is to be understood that the storage caddy for an ironing board is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the storage caddy for an ironing board.

It is therefore important that the claims be regarded as including such equivalent construction insofar as they do not depart from the spirit and scope of the storage caddy for an ironing board. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
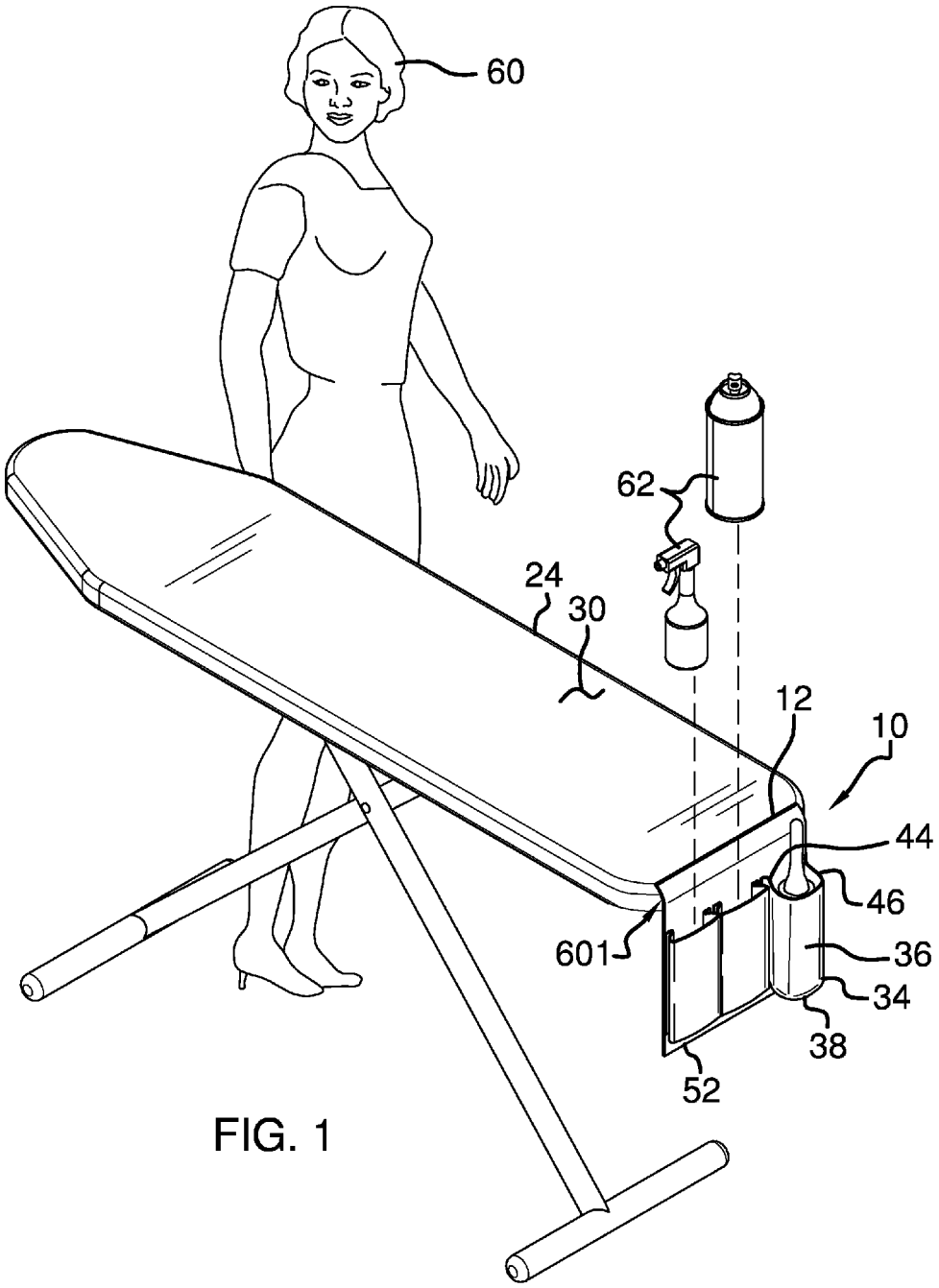
FIG. 1 is a perspective view of a caddy assembly according to an embodiment of the disclosure.
Figure 2:
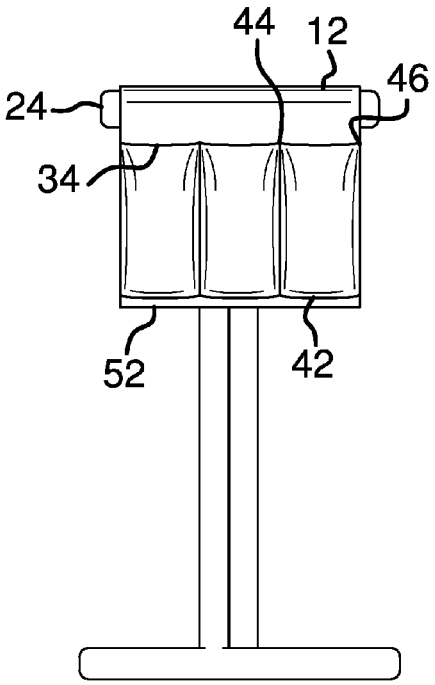
FIG. 2 is a rear side view of an embodiment of the disclosure.
Figure 3:
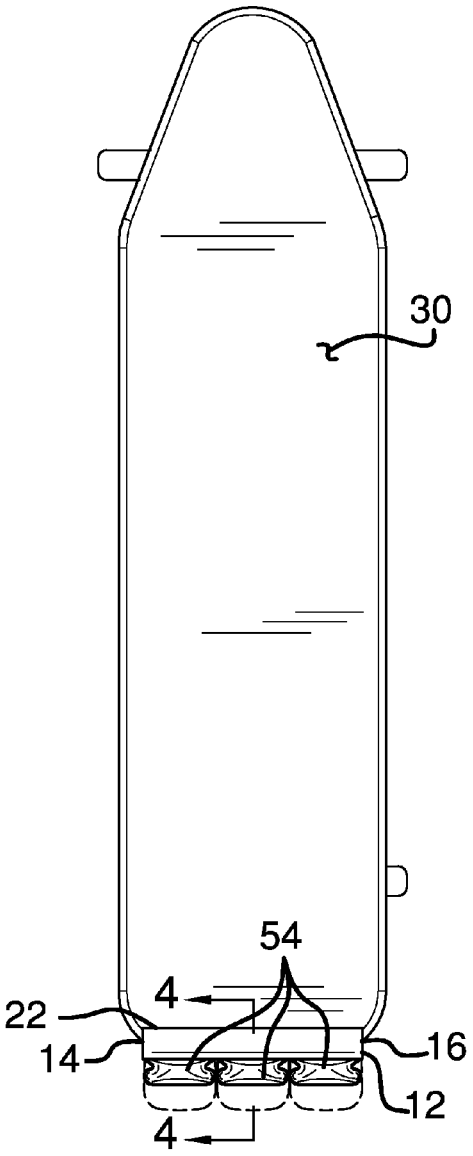
FIG. 3 is a top view of an embodiment of the disclosure.
Figure 4:
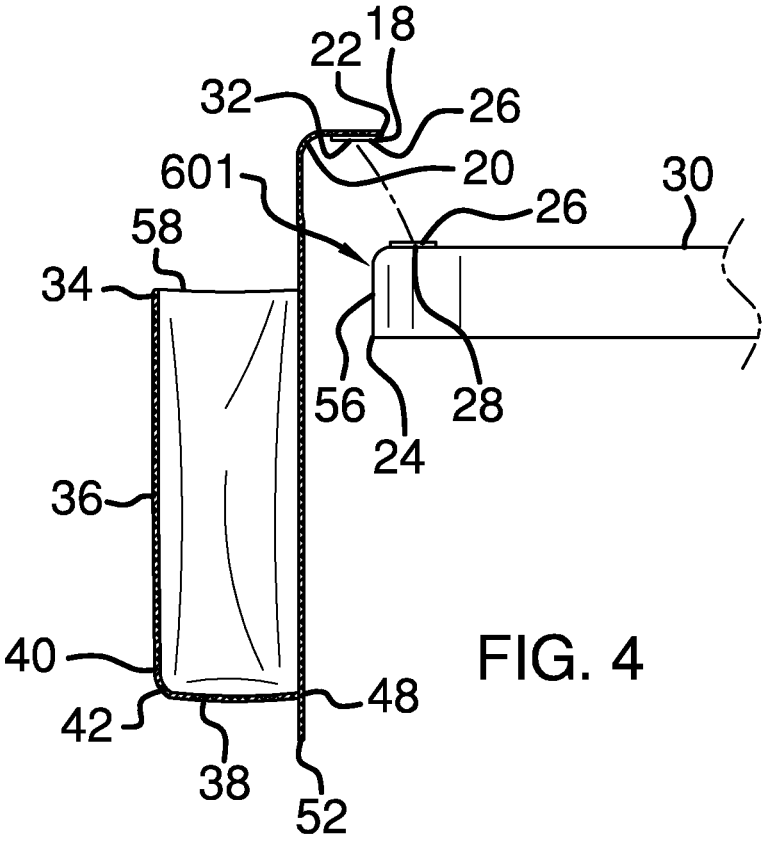
FIG. 4 is a cross sectional view of an embodiment of the disclosure along line 4-4 in FIG. 3.
Figure 5:
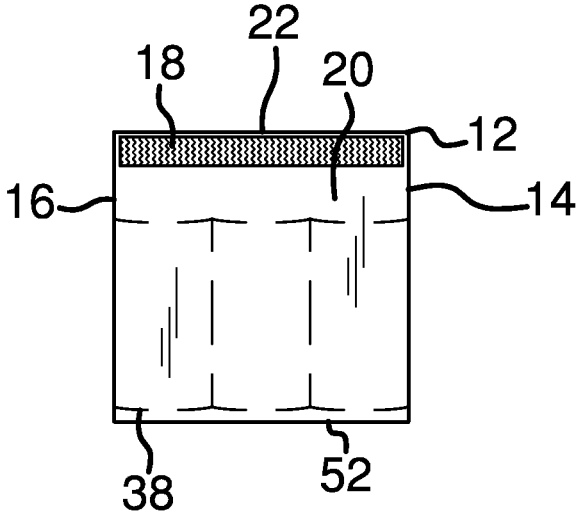
FIG. 5 is a back view of an embodiment of the disclosure.
Figure 6:
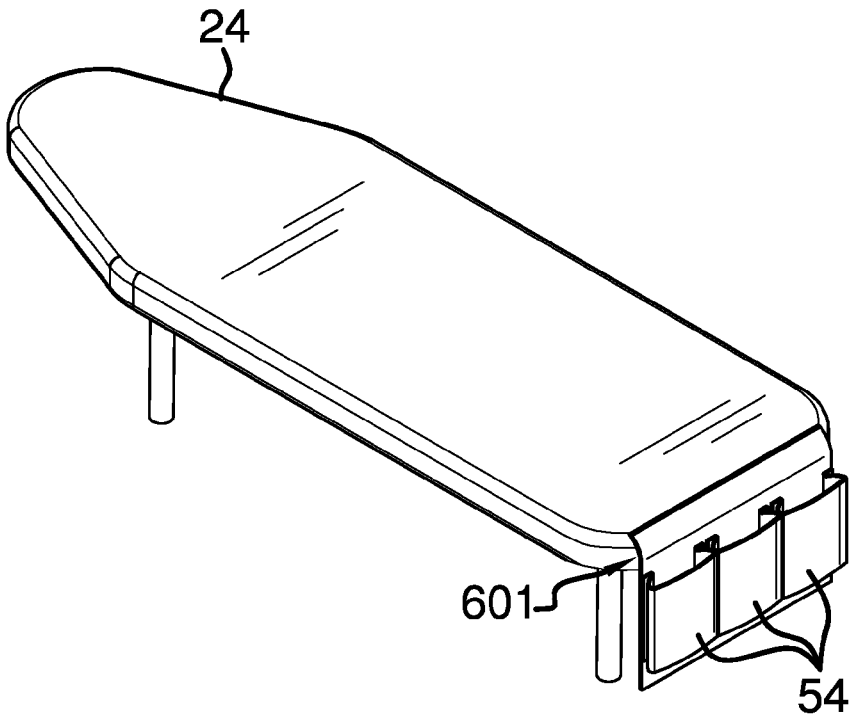
FIG. 6 is another perspective view of an alternative embodiment of the disclosure.

As best illustrated in FIGS. 1 through 6, the caddy assembly 10 generally comprises a panel 12 that has a first end 14 and a second end 16. The panel 12 is elongated between the first 14 and second 16 ends of the panel 12. Additionally, the panel 12 has a width that is greater than a length of the panel 12. The panel 12 has a rectangular shape.

A coupler 18 is coupled to a rear side 20 of the panel 12 proximate an upper edge 22 of the panel 12. The coupler 18 extends between the first 14 and second 16 ends of the panel 12. The coupler 18 engages an ironing board 24. The panel 12 is retained on the ironing board 24. The ironing board 24 may be of any conventional design.

The coupler 18 is one of a pair of the couplers 26. A second one 28 of the pair of couplers 26 is coupled to a top surface 30 of the ironing board 24. Each of a first one 32 of the pair of couplers 26 and the second coupler 28 are complimentary. The pair of couplers 26 may each comprise a hook and loop fastener of any conventional design.

A pocket 34 is provided. The pocket 34 has a front side 36 and a bottom side 38. A bottom edge 40 of the front side 36 of the pocket 34 is coupled to a front edge 42 of the bottom side 38 of the pocket 34. The front side 36 of the pocket 34 extends upwardly from the bottom side 38 of the pocket 34.

The front edge 42 of the bottom side 38 of the pocket 34 is curvilinear. Each of a first lateral edge 44 and a second lateral edge 46 of the front side 36 of the pocket 34 are positioned proximate a back edge 48 of the bottom side 38 of the pocket 34. Additionally, each of the first 44 and second 46 lateral edges of the front side 36 of the pocket 34 and the back edge 48 of the bottom side 38 of the pocket 34 are coupled to a forward side 50 of the panel 12. The back edge 48 of the bottom side 38 of the panel 12 is positioned proximate a lower edge 52 of the panel 12.

The pocket 34 is one of a plurality of the pockets 54. Each of the plurality of pockets 54 is evenly distributed between the first 14 and second 16 ends of the panel 12. The first coupler 32 engages the second coupler 28. Moreover, the panel 12 hangs downwardly from an outside edge 56 of the ironing board 24. A top 58 of each of the plurality of the pockets 54 is accessible to a user 60.

In use, the first 32 and second 28 couplers are coupled together. Objects 62 are positioned within the plurality of pockets. The ironing board 24 is utilized in the convention of ironing while the assembly 10 is coupled to the ironing board 24. The assembly 10 keeps the objects 62 nearby while the user 60 utilizes the ironing board 24. It shall be noted that the assembly 10 may be installed on a rear edge 601 of the ironing board 24.

With respect to the above description, it is to be realized that the optimum dimensional relationship for the various components of the caddy assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the caddy assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A caddy assembly configured to be coupled to an ironing board, said assembly comprising:

a panel configured to be coupled to the ironing board;

a coupler coupled to said panel; said coupler engaging the ironing board such that said panel is retained on the ironing board; and a pocket coupled to said panel, said panel containing an object such that the object is accessible to a user;

wherein said panel having a first end and a second end;

wherein said panel being elongated between said first and second ends of said panel;

wherein said coupler being coupled to a rear side of said panel proximate an upper edge of said panel;

wherein said coupler extending between the first end and the second end of said panel;

wherein said pocket having a front side and a bottom side;

wherein a bottom edge of said front side of said pocket being coupled to a front edge of said bottom side of said pocket;

wherein such that said front side of said pocket extends upwardly from said bottom side of said pocket;

wherein said front edge of said bottom side of said pocket being curvilinear such that each of a first lateral edge and a second lateral edge of said front side of said pocket are positioned proximate a back edge of said bottom side of said pocket.

2. The assembly according to claim 1, wherein each of a first lateral edge and a second lateral edge of said front side of said pocket and a back edge of said bottom side of said pocket being coupled to a forward side of said panel.

3. The assembly according to claim 2, wherein said back edge of said bottom side of said panel is positioned proximate a lower edge of said panel.

4. The assembly according to claim 1, wherein said pocket being one of a plurality of said pockets.

5. The assembly according to claim 4, wherein each of said plurality of pockets being evenly distributed between a first end and a second end of said panel.

6. The assembly according to claim 5, wherein said coupler engaging a top surface of said ironing board proximate an outside edge of the ironing board.

7. The assembly according to claim 6, wherein said assembly is installed on a rear edge of the ironing board.

8. The assembly according to claim 6, wherein said panel hangs downwardly from the outside edge of the ironing board having a top of each of a plurality of said pockets being accessible to the user.

9. A caddy assembly configured to be coupled to an ironing board, said assembly comprising:

a panel having a first end and a second end, said panel being configured to be coupled to the ironing board;

a coupler coupled to said panel; said coupler engaging the ironing board such that said panel is retained on the ironing board;

a pocket coupled to said panel, said panel containing an object such that the object is accessible to a user;

wherein said panel being elongated between said first and second ends of said panel; said coupler being coupled to a rear side of said panel proximate an upper edge of said panel; said coupler extending between said first and second ends of said panel;

wherein said pocket having a front side and a bottom side; a bottom edge of said front side of said pocket being coupled to a front edge of said bottom side of said pocket such that said front side of said pocket extends upwardly from said bottom side of said pocket; said front edge of said bottom side of said pocket being curvilinear such that each of a first lateral edge and a second lateral edge of said front side of said pocket are positioned proximate a back edge of said bottom side of said pocket;

wherein each of said first lateral edge and said second lateral edge of said front side of said pocket and said back edge of said bottom side of said panel being coupled to a forward side of said panel wherein said back edge of said bottom side of said panel is positioned proximate a lower edge of said panel;

wherein said pocket being one of a plurality of said pockets; each of said plurality of pockets being evenly distributed between a first end and a second end of said panel; said coupler engaging a top surface of said ironing board proximate an outside edge of the ironing board wherein said panel hangs downwardly from the outside edge of the ironing board having a top of each of a plurality of said pockets being accessible to the user; wherein said assembly is installed on a rear edge of the ironing board.

* * * * *